US010882324B2

(12) United States Patent
Cantrell et al.

(10) Patent No.: US 10,882,324 B2
(45) Date of Patent: Jan. 5, 2021

(54) PRINTER VALVES

(71) Applicant: Hewlett-Packard Development Company, L.P., Houston, TX (US)

(72) Inventors: John J. Cantrell, Vancouver, WA (US); Sierra Lila Wolf, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/178,750

(22) Filed: Nov. 2, 2018

(65) Prior Publication Data

US 2020/0139717 A1 May 7, 2020

(51) Int. Cl.
*B41J 2/175* (2006.01)

(52) U.S. Cl.
CPC ..... *B41J 2/17596* (2013.01); *B41J 2/17509* (2013.01); *B41J 2/17523* (2013.01); *B41J 2/17553* (2013.01)

(58) Field of Classification Search
CPC ..... B41J 2/17509
See application file for complete search history.

(56) References Cited

U.S. PATENT DOCUMENTS

| | | | | |
|---|---|---|---|---|
| 5,650,811 | A | 7/1997 | Seccombe | |
| 5,751,300 | A | 5/1998 | Cowger | |
| 5,774,154 | A | 6/1998 | Underwood | |
| 6,244,697 | B1 | 6/2001 | Powers et al. | |
| 6,565,197 | B1 | 5/2003 | Murray et al. | |
| 2001/0020970 | A1* | 9/2001 | Kuribayashi | B41J 2/175 347/85 |
| 2001/0040610 | A1* | 11/2001 | Kurata | B41J 2/17509 347/85 |
| 2005/0285886 | A1* | 12/2005 | Okamoto | B41J 2/17509 347/7 |
| 2008/0158284 | A1* | 7/2008 | Nakamura | B41J 2/17509 347/20 |
| 2012/0008882 | A1* | 1/2012 | Justice | B41J 2/175 383/43 |
| 2017/0191595 | A1* | 7/2017 | Van Scyoc | F16L 37/32 |

* cited by examiner

*Primary Examiner* — Shelby L Fidler
(74) *Attorney, Agent, or Firm* — Brooks Cameron & Huebsch PLLP

(57) ABSTRACT

Example implementations relate to printer valve seals. In some examples, a printer valve to receive print substance from a fluid conduit and transmit the received print substance to a print cartridge can include a valve neck having a first seal member to provide a seal between the valve neck and an inlet of the print cartridge, and an actuator having a second seal member to form a seal within a valve body of the printer valve while the valve neck is detached from the inlet of the print cartridge.

8 Claims, 5 Drawing Sheets

PRINTER VALVES

BACKGROUND

An imaging device, such as a printer, may be used to form markings on a physical medium. For example, the printer may receive print data corresponding to text and/or images and may use the received print data to form markings on the physical medium. One technique for forming markings on a medium includes transferring ink, toner, and/or other material to the physical medium.

DETAILED DESCRIPTION

Figure 1:
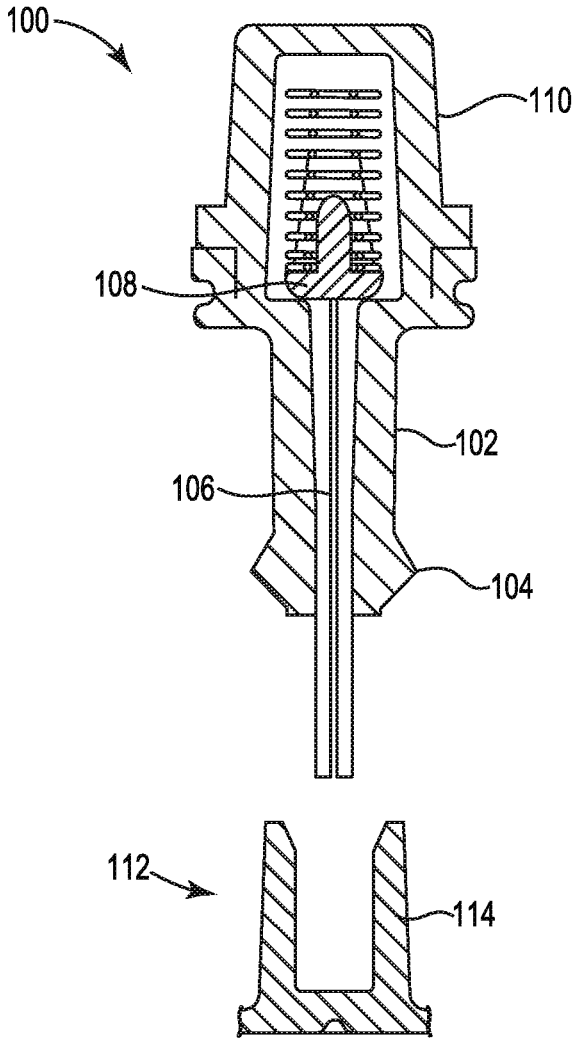
FIG. 1 is a cutaway perspective view of an example printer valve and a portion of an print cartridge consistent with the disclosure.

Some printers may utilize a print substance, such as ink, toner, and/or other material to form markings on a medium. As used herein, the term "printer" refers to any hardware device with functionalities to physically produce representations (e.g., images, text, etc.) of print data on a medium via application of print substance on the print medium. In some examples, a "medium" may include paper, plastics, composite, metal, wood, etc.

Markings, including text and images, may be formed on a print medium in response to reception of print data corresponding to the markings. The print data may comprise signals and/or states corresponding to physical representations (e.g., images, text, etc.) to be formed on a single print medium, or across multiple print media (e.g., pages). The print data, when transmitted to a printer, may be referred to as a print job.

For example, a printer may receive print data corresponding to physical representations such as images, text, etc. (e.g., potentially comprising multiple pages of print media). The printer may use the print data to determine which areas of a print medium are to have print substance applied (e.g., using a print cartridge) for a particular print job. In response to print substance being applied, physical representations of the print data (e.g., images, text, etc.) may be formed on the print medium during the print job.

One example of a printer contemplated by the disclosure may include a continuous ink delivery printer. The continuous ink delivery printer can include a print cartridge in fluid communication with a feeder tank via a fluid conduit. As used herein, the term "conduit" refers to a passageway to convey a fluid. As used herein, the term "print cartridge" refers to a component of a printer that deposits print substance onto a medium during a print job. The feeder tank can be connected with the print cartridge via the fluid conduit and a manifold such that the feeder tank can continuously deliver print substance to the print cartridge during a print job.

During a print job of a continuous ink delivery printer, a print cartridge can deposit print substance onto a medium, which can cause a negative gauge pressure inside of the print cartridge. The pressure differential can cause print substance to move from the feeder tank, through the fluid conduit and to the print cartridge to continuously replenish print substance in the print cartridge for deposition onto a medium during a print job.

During an initial setup of a continuous ink delivery printer, print substance included in a feeder tank can be provided to a print cartridge to prime the fluid conduit connecting the feeder tank with the print cartridge. As used herein, the term "prime" refers to removing air from an enclosed area. For example, air included in the fluid conduit connecting the feeder tank with the print cartridge can be removed from the fluid conduit when priming the fluid conduit.

Print substance can be provided to the print cartridge to prime the fluid conduit by depositing, by the print cartridge, preloaded print material to create a pressure differential in the print cartridge to cause print substance to move from the feeder tank, through the fluid conduit, and to the print cartridge. Moving the print substance from the feeder tank, through the fluid conduit, and to the print cartridge can force air in the fluid conduit into the print cartridge. The print cartridge can receive an amount of air that is included in the fluid conduit during the initial setup of the printer while still being functional.

At times, a user may disconnect the fluid conduit from the print cartridges. For example, a user may desire to inspect or replace a print cartridge. Disconnecting the fluid conduit from the print cartridge may cause the fluid conduit to lose primed print substance back into the feeder tank. In such an example, re-priming the fluid conduit can force additional air into a print cartridge, which may cause it to malfunction or be destroyed, reducing the operational life of the print cartridge. In such a case, a user of the printing device may have to prematurely replace print cartridges which can result in costs to the user.

Printer valves according to the disclosure can allow for disconnection of a fluid conduit from a print cartridge while maintaining a print substance prime. Printer valves according to the disclosure can utilize a valve having a first seal member and a second seal member allow for disconnection of a fluid conduit from a print cartridge without losing print substance prime. Accordingly, a user may disconnect a print cartridge for inspection and/or replacement without losing print substance prime. Preventing the loss of print substance prime can prolong an operational life of a print cartridge.

FIG. 1 is a cutaway perspective view of an example printer valve 100 and a portion of an example print cartridge 112 consistent with the disclosure. As illustrated in FIG. 1, printer valve 100 can include valve neck 102, first seal member 104, actuator 106, second seal member 108, and valve body 110. Print cartridge 112 can include inlet 114.

Printer valve 100 can be a valve that can receive print substance from a fluid conduit. As used herein, the term "valve" refers to a device to control (e.g., prevent or allow) the flow of a fluid. For example, as illustrated in FIG. 1, printer valve 100 is disconnected from print cartridge 112 such that no print substance is able to flow from printer valve 100 to print cartridge 112. Printer valve 100 can prevent print substance from flowing from printer valve 100 to print cartridge 112 to maintain a negative pressure within valve body 110 to keep the fluid conduit (e.g., not illustrated in FIG. 1) primed until printer valve 100 is connected to print cartridge 112, as is further described herein.

Printer valve 100 can include an actuator 106. As used herein, the term "actuator" refers to a mechanism to initiate an action. For example, actuator 106 can initiate flow of print substance when printer valve 100 is connected to print cartridge 112, as is further described herein with respect to FIG. 4.

Actuator 106 can include a second seal member 108. As used herein, the term "seal member" refers to a constituent part of a mechanism for preventing fluid communication between a first location and a second location. For example, seal member 108 can form a seal (e.g., preventing fluid communication) within valve body 110 of printer valve 100 while valve neck 102 is detached from inlet 114 of print cartridge 112. As used herein, the term "body" refers to a physical structure comprising a section of printer valve 100. As used herein, the term "neck" refers to a slender physical structure comprising a section of printer valve 100 that can be longer and narrower in dimension relative to valve body 110. As used herein, the term "inlet" refers to a structure to receive an object. Seal member 108 can prevent or allow fluid communication between valve body 110 and valve neck 102, as is further described herein.

As illustrated in FIG. 1, actuator 106 can be located in valve neck 102 and valve body 110. For example, actuator 106 can include dimensions such that a portion of actuator 106 is located in valve neck 102 and a portion of actuator 106 is located in valve body 110.

As illustrated in FIG. 1, seal member 108 can prevent fluid communication between valve body 110 and valve neck 102 as a result of printer valve 100 (e.g., valve neck 102) being detached from print cartridge 112 (e.g., inlet 114). For example, seal member 108 can block a fluid conduit between valve body 110 and valve neck 102 to prevent fluid communication of print substance between valve body 110 and valve neck 102.

Valve body 110 and valve neck 102 can make up printer valve 100 such that printer valve 100 is a single unitary element. For example, valve body 110 and valve neck 102 can make up printer valve 100, where printer valve 100 is a single unitary piece of material. However, examples of the disclosure are not so limited. For example, valve body 110 and valve neck 102 can be separate elements such that valve body 110 and valve neck 102 can interface together to form printer valve 100.

Seal member 108 can comprise an elastomeric material. As used herein, the term "elastomeric" refers to a polymer material having viscoelastic properties. The elastomeric material of seal member 108 can provide the fluid tight seal between valve body 110 and valve neck 102. The fluid tight seal can be provided by seal member 108 while printer valve 100 is detached from print cartridge 112.

As described above, the fluid tight seal provided by the elastomeric material of seal member 108 can maintain negative pressure within valve body 110. As used herein, the term "negative pressure" refers to a state of an area in which a fluid is drawn towards the area from an area of positive pressure. In an example in which a user disconnects printer valve 100 from print cartridge 112, the fluid tight seal provided by seal member 108 can maintain the tendency of the print substance to flow from a feeder tank, and through a fluid conduit to printer valve 100. The fluid tight seal provided by seal member 108 can maintain the prime of print substance in the fluid conduit when printer valve 100 is disconnected from print cartridge 112.

Actuator 106 can include a length such that the length of actuator 106 is greater than a combined length of valve body 110 and valve neck 102. For example, the actuator 106 can include a length such that a portion of actuator 106 protrudes from a bottom portion of valve neck 102. The protruding portion of actuator 106 can contact a surface of print cartridge 112 to cause actuator 106 to move to allow communication of print material from valve body 110 to valve neck 102 and to print cartridge 112, as is further described in connection with FIG. 4.

Valve neck 102 can include first seal member 104. Seal member 104 can provide a seal between valve neck 102 and an inlet 114 of print cartridge 112 when printer valve 100 is attached to inlet 114 of print cartridge 112. In one example, seal member 104 can contact (and create a seal) with inlet 114 prior to contact between actuator 106 and inlet 114, as shall be discussed further hereinafter with reference to FIGS. 4A and 4B.

Similar to seal member 108, seal member 104 can comprise an elastomeric material. The elastomeric material of seal member 104 can provide the fluid tight seal between valve neck 102 and inlet 114. The fluid tight seal can be provided by seal member 104 while printer valve 100 is attached to print cartridge 112.

Figure 2:
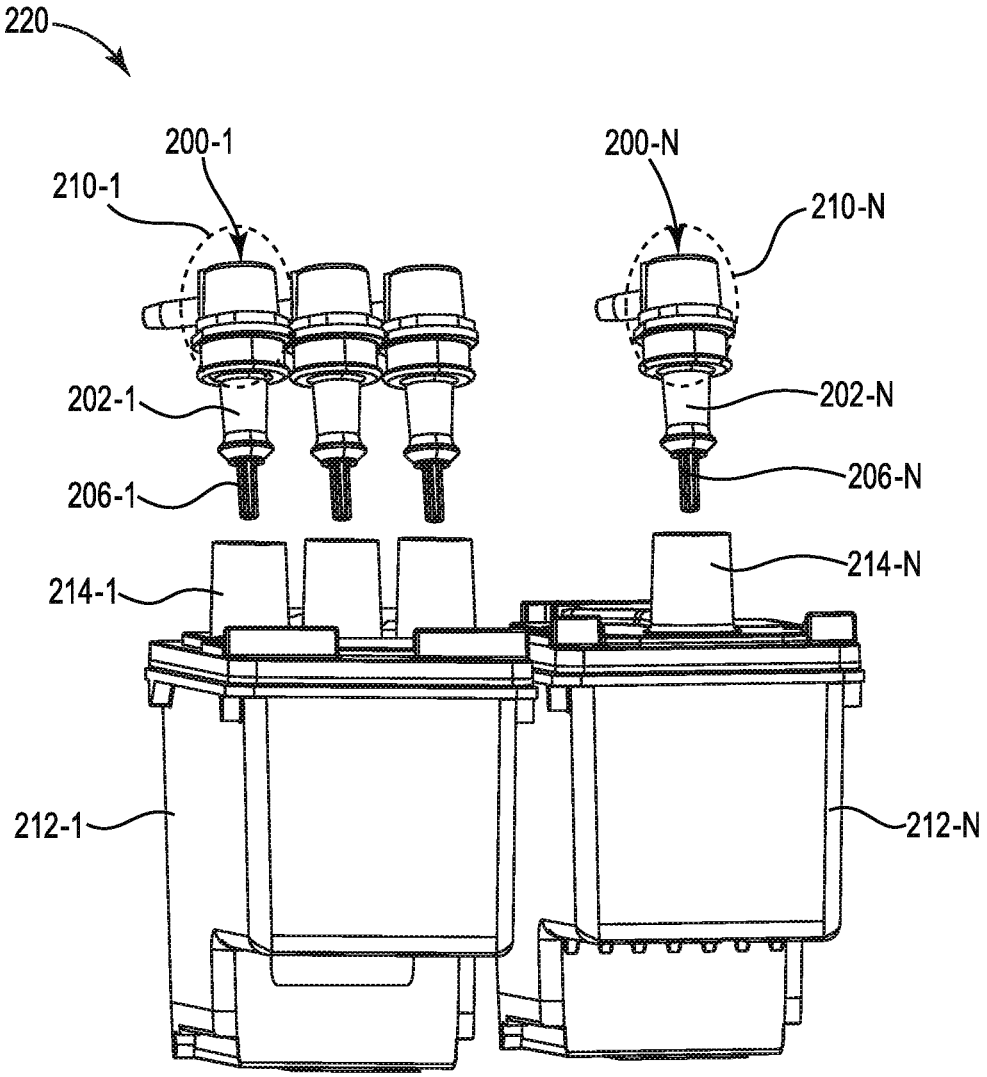
FIG. 2 is a perspective view of an example system consistent with the disclosure.

FIG. 2 is a perspective view of an example system 220 consistent with the disclosure. As illustrated in FIG. 2, system 220 can include valve bodies 210 (of which, valve bodies 210-1 and 210-N are labeled), valve necks 202 (of which, valve necks 202-1 and 202-N are labeled), actuators 206 (of which, actuators 206-1 and 206-N are labeled), print cartridges 212-1 and 212-N, and inlets 214 (of which, inlets 214-1 and 214-N are labeled).

As illustrated in FIG. 2, in some examples system 220 can include multiple printer valves 200-1, 200-N (referred to collectively herein as printer valves 200). The multiple printer valves 200 can include valve bodies 210-1, 210-N, respectively (referred to collectively herein as valve bodies 210), valve necks 202-1, 202-N, respectively (referred to collectively herein as valve necks 202), and actuators 206-1, 206-N, respectively (referred to collectively herein as actuators 206. Additionally, as illustrated in FIG. 2, the multiple printer valves 200 can be detached from inlets 214-1, 214-N (referred to collectively herein as inlets 214) of print cartridges 212-1, 212-N (referred to collectively herein as print cartridges 212).

The multiple printer valves 200 may be utilized for different print substances. For example, some printers may apply a physical representation on different portions of a print medium in varying colors. Separate colors can be provided to print cartridges 212 in order to perform a print job using varying colors by providing differently colored print substances to print cartridges 212.

The differently colored print substances can be provided to print cartridges 212 by corresponding fluid conduits from feeder tanks. For example, a cyan print substance can be provided to one of the printer valves 200, a magenta print substance can be provided to another one of the printer valves 200, a yellow print substance can be provided to another one of the printer valves 200, and a black print substance can be provided to another one of the printer valves 200. The printer can utilize the cyan, magenta, yellow, and black print substances to create various color combinations for application to a print medium.

In an example in which the printer valves 200 may be detached from the print cartridges 212, each of the printer valves 200 can include actuators 206 each having seal members (e.g., not illustrated in FIG. 2 for clarity and so as not to obscure examples of the disclosure) to provide a seal between the valve necks 202 and the valve bodies 210. Additionally, included on each of the valve necks 202 of the printer valves 200 but not labeled in FIG. 2 are seal members to provide a seal between the valve necks 202 and the inlets 214 when printer valves 200 are attached to print cartridges 212.

When detaching the printer valves 200 from the print cartridges 212, the seal members of the actuators 206 can provide a seal between the valve necks 202 and the valve bodies 210 prior to the seal between the valve necks 202 and the inlets 214 being lost as a result of the valve necks 202 being removed from inlets 214 of the print cartridges 212. Providing the seal between the valve necks 202 and the valve bodies 210 prior to the seal between the valve necks 202 and the inlets 214 being lost can preserve negative pressure within valve bodies 210, which, as a result, prevents the print substance prime from being lost in the corresponding fluid conduits attached to each printer valve 200.

Figure 3:
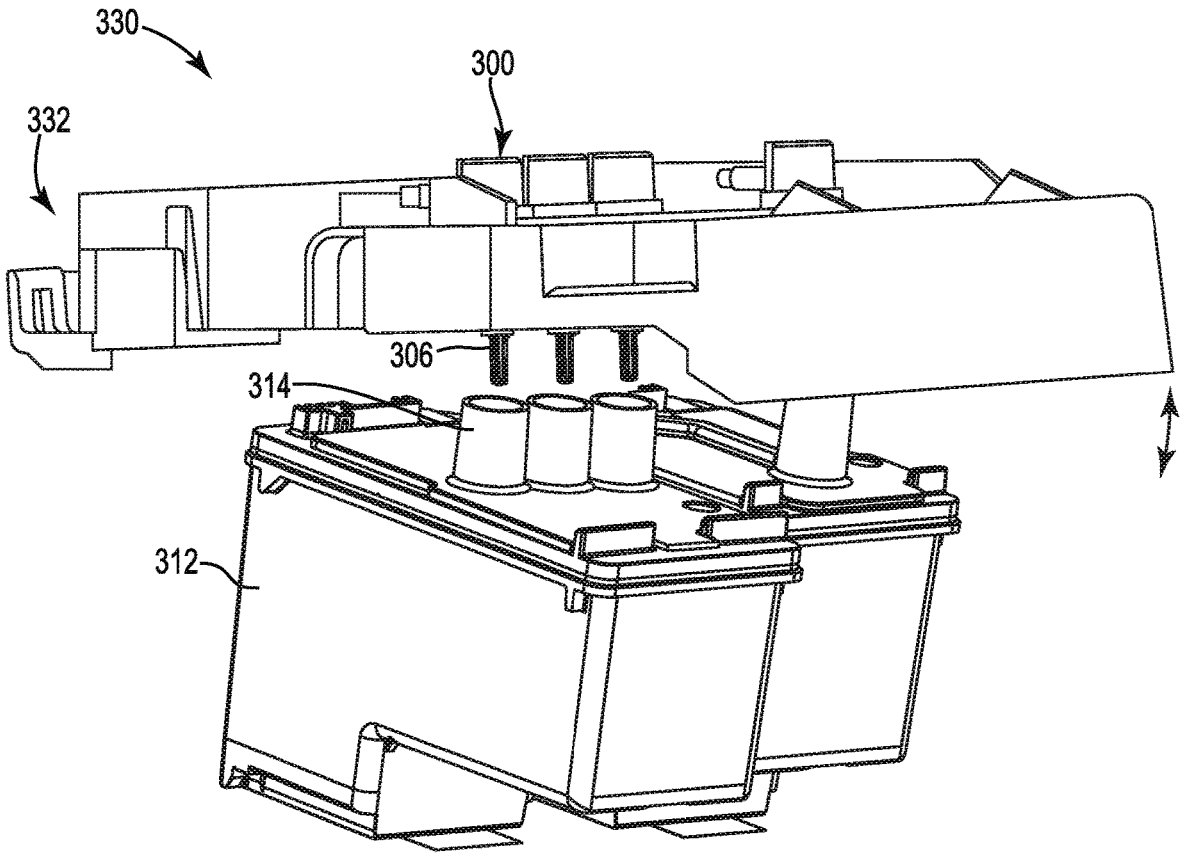
FIG. 3 is a perspective view of an example system consistent with the disclosure.

FIG. 3 is a perspective view of an example system 330 consistent with the disclosure. As illustrated in FIG. 3, system 330 can include frame 332 and print cartridge 312. Frame 332 can include printer valve 300. Printer valve 300 can include actuator 306. Print cartridge 312 can include inlet 314.

As illustrated in FIG. 3, system 330 can include a frame 332. As used herein, the term "frame" refers to a rigid structure to support components of a printing device. As previously described in connection with FIG. 2, a printer can utilize differently colored print substances. The differently colored print substances can be provided to print cartridges to create varying colors on a print medium. Frame 332 can provide structural support for different fluid conduits and their corresponding attached printer valves such that the fluid conduits can route the print substances to particular printer valves.

In some examples, frame 332 can rotate about an axis (e.g., along a back portion of frame 332). For example, frame 332 can be rotatable such that printer valve 300 can be detached from print cartridge 312. Utilizing rotatable frame 332 can allow a user to easily detach printer valves 300 from corresponding print cartridges 312 for inspection, replacement, etc.

Figure 4A:
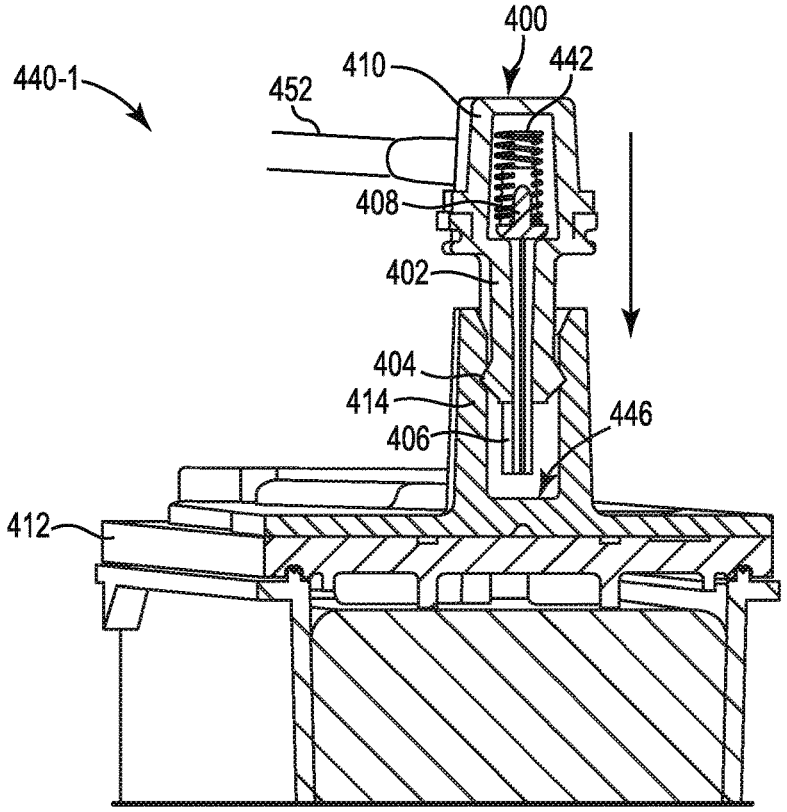
FIGS. 4A and 4B are cutaway perspective views of an example system consistent with the disclosure.
Figure 4B:
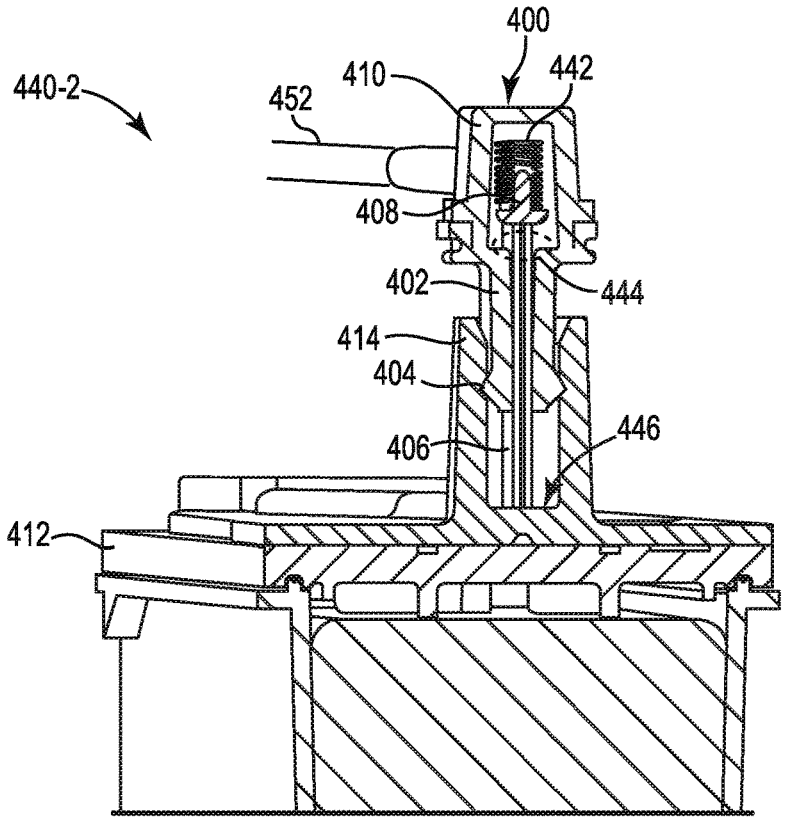

FIGS. 4A and 4B show a cutaway perspective view of an example system 440 (example system 440-1 in FIG. 4A and example system 440-2 in FIG. 4B) consistent with the disclosure. System 440-1 illustrates seal member 408 providing a seal within valve body 410 of printer valve 400, and system 440-2 illustrates seal member 404 providing a seal between valve neck 402 and inlet 414, as is further described herein.

As previously described in connection with FIG. 1, printer valve 400 can include a valve neck 402 and a valve body 410. Printer valve 400 can include actuator 406, where actuator 406 can be located in valve body 410 and valve neck 402 and include a portion that protrudes from valve neck 402. Valve neck 402 can include a seal member 404 and actuator 406 can include seal member 408. Printer valve 400 can receive print substance from a fluid conduit and transmit the received print substance to print cartridge 412 when printer valve 400 is attached to print cartridge 412, as is further described herein.

As illustrated in FIGS. 4A and 4B, systems 440-1 and 440-2 can include a print cartridge 412. Print cartridge 412 can receive print substance from a feeder tank via fluid conduits and printer valve 400 to deposit print substance onto a medium during a print job. Print cartridge 412 can receive print substance from printer valve 400 via inlet 414. For example, inlet 414 can receive valve neck 402 such that printer valve 400 can transfer print substance to print cartridge 412, as is further described herein.

A process to attach/detach printer valve 400 from print cartridge 412 is described herein. As shown by system 440-1, printer valve 400 is in a partially detached state with respect to print cartridge 412. In this partially detached state (in which seal member 404 is still in contact with inlet 414), no print substance is able to flow through printer valve 400 and negative pressure in valve body 410 is maintained such that a prime of print substance in fluid conduit 452 is also maintained. At system 440-1, printer valve 400 can begin to be attached to print cartridge 412.

For example, printer valve 400 can begin to be lowered towards print cartridge such that valve neck 402 is inserted into inlet 414 of print cartridge 412. As previously described in connection with FIG. 1, valve neck 402 includes seal member 404. As valve neck 402 is inserted into inlet 414, seal member 404 provides a seal between valve neck 402 and inlet 414 of print cartridge 412. Seal member 404 can provide the seal between valve neck 402 and inlet 414 via an interference fit. As used herein, the term "interference fit" refers to a fit between two parts in which an external dimension of a first part slightly exceeds an internal dimension of a second part into which the first part is to fit. For example, the external dimension of seal member 404 can slightly exceed an internal dimension of inlet 414 such that the internal dimension of inlet 414 can compress seal member 404 to provide the seal between inlet 414 and valve neck 402.

As illustrated in FIGS. 4A and 4B, valve body 410 includes biasing member 442. Biasing member 442 can be connected to actuator 406, where actuator 406 can include seal member 408. As used herein, the term "biasing member" refers to a mechanism to exert a force to influence another object. For example, biasing member 442 can exert a force on actuator 406 to cause actuator 406 to remain stationary until acted on by another force. That is, biasing member 442 can exert a force on actuator 406 to cause actuator 406 to remain stationary such that seal member 408 provides a seal between valve neck 402 and valve body 410 to maintain negative pressure in valve body 410 until printer valve 400 is attached to print cartridge 412, as is further described herein.

In some examples, biasing member 442 can be a spring. As used herein, the term "spring" refers to an elastic mechanical object that stores mechanical energy. In some examples, the spring can be a helical/coil spring. For example, the spring can be naturally in an extended state and, in response to an application of a force to the spring, be moved to a compressed (e.g., a deflected) state.

As illustrated in FIG. 4 in system 440-1, biasing member 442 is in an extended state. As used herein, the term "extended state" refers to a state in which biasing member 442 is stretched out from its compressed state. While printer valve 400 is detached from inlet 414 of print cartridge 412, biasing member 442 can be in an extended state such that fluid conduit 444 between valve neck 402 and valve body 410 is closed by seal member 408. Keeping biasing member 442 in an extended state while printer valve 400 is detached from inlet 414 of print cartridge 412 form the seal within valve body 410 of printer valve 400 via seal member 408 to maintain negative pressure in valve body 410, resulting in maintaining a print substance prime in fluid conduit 452.

As described above, as valve neck 402 is lowered towards print cartridge 412 into inlet 414, seal member 404 can form a seal between valve neck 402 and inlet 414 of print cartridge 412. Seal member 404 can maintain the seal between valve neck 402 and inlet 414 while printer valve 400 is attached to print cartridge 412. As valve neck 402 is lowered towards print cartridge 412 into inlet 414, the protruding portion of actuator 406 (e.g., the portion of actuator 406 protruding from valve neck 402) can be moved towards a lower surface 446 of inlet 414.

Print cartridge inlet 414 can include lower surface 446. As used herein, the term "lower surface" refers to a strip of rigid material included in inlet 414 that actuator 406 can contact to move biasing member from the extended state to a compressed state. As used herein, the term "compressed state" refers to a state in which biasing member 442 is pressed together.

Lower surface 446 can span a width of inlet 414. Lower surface 446 can be adjacent to an aperture included in inlet 414 such that actuator 406 can contact lower surface 446, and print substance can flow around lower surface 446 and through the aperture into print cartridge 412, as is further described herein.

As illustrated in system 440-2, printer valve 400 can be lowered such that lower surface 446 can apply a force to actuator 406. In response to the application of force to actuator 406, biasing member 442 can move from an extended state to a compressed state. For example, as illustrated in system 440-2, biasing member 442 can move in an "upwards" direction relative to the orientation of printer valve 400 in FIG. 4.

By applying force to actuator 406 by lower surface 446 as printer valve 400 is moved towards print cartridge 412, actuator 406 and biasing member 442 can be moved in the opposite direction (e.g., upwards), causing the biasing member 442 to be moved to a compressed state as well as the seal member 408 attached to actuator 406 to be moved upwards. By moving seal member 408 upwards, flow of print substance from printer valve 400 to print cartridge 412 can be enabled.

As a result of seal member 408 being moved upwards, fluid conduit 444 can be opened. As fluid conduit 444 is opened, print substance included in fluid conduit 452 can be moved through valve body 410, through fluid conduit 444, through valve neck 402, around lower surface 446, and into print cartridge 412. As a result of seal member 404 creating a seal between valve neck 402 and inlet 414 prior to seal member 408 being moved to open fluid conduit 444, negative pressure in valve body 410 can be maintained. Maintaining negative pressure in valve body 410 can cause print substance to be continually supplied to print cartridge 412 during print jobs to allow the printer to continue to perform print jobs. The printer can continue to perform print jobs until the print cartridge 412 has to be inspected, replaced, etc. To inspect/replace print cartridge 412, printer valve 400 can be detached from print cartridge 412.

Detaching print cartridge 412 can include stopping a flow of print substance through printer valve 400 by moving printer valve 400 away from print cartridge 412. As printer valve 400 is moved away from print cartridge 412, actuator 406 can begin to be moved in a "downward" direction as oriented relative to printer valve 400 as illustrated in FIG. 4. As a result of the movement of printer valve 400 away from print cartridge 412, biasing member 442 can move from the compressed state to the extended state causing actuator 406 to move in a downward direction.

As biasing member 442 moves from the compressed state to the extended state causing actuator 406 to move in a downward direction, seal member 408 can close fluid conduit 444, creating the seal between valve body 410 and valve neck 402 (e.g., creating the seal within valve body 410). Seal member 408 can create the seal between valve body 410 and valve neck 402 prior to seal member 404 losing the seal between valve neck 402 and inlet 414. As the valve neck 402 is moved away from inlet 414, the seal created within valve body 410 (e.g., between valve body 410 and valve neck 402) can maintain negative pressure within valve body 410 as the seal between valve neck 402 and inlet 414 is lost (e.g., as a result of valve neck 402 exiting inlet 414.

Figure 5:
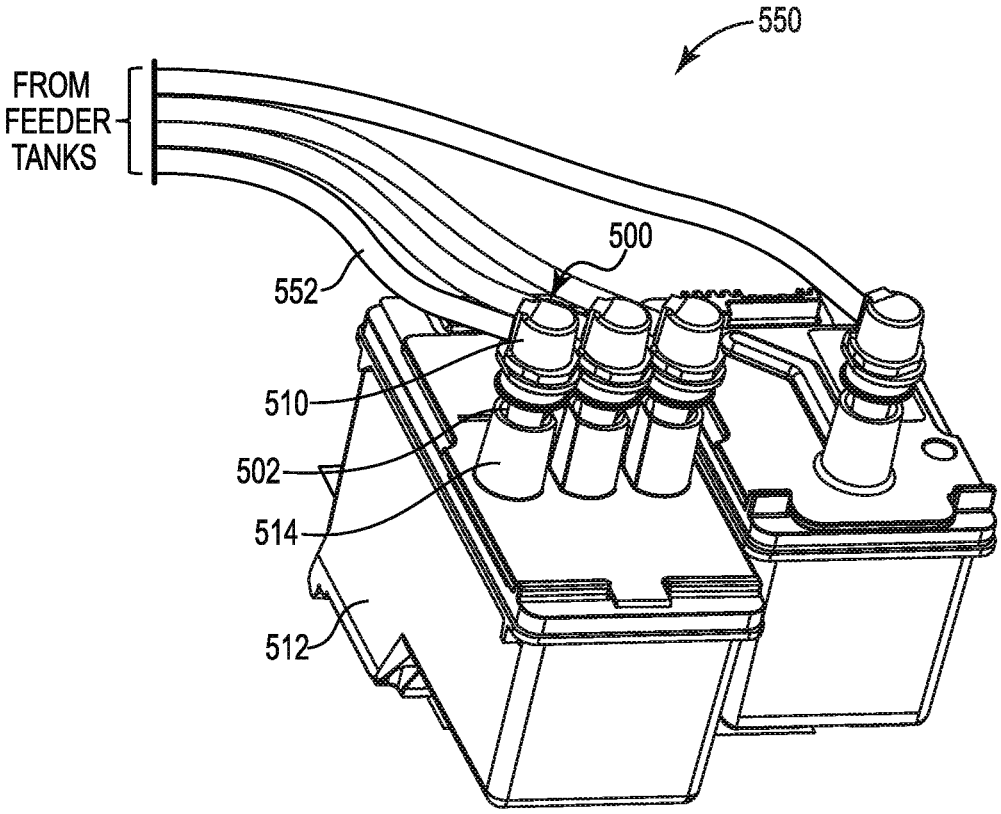
FIG. 5 is a perspective view of an example system consistent with the disclosure.

FIG. 5 is a perspective view of an example system 550 consistent with the disclosure. As illustrated in FIG. 5, system 550 can include printer valve 500, print cartridge 512, and fluid conduit 552. Printer valve 500 can include valve body 510 and valve neck 502. Print cartridge 512 can include inlet 514.

As illustrated in FIG. 5, printer valve 500 can be attached to print cartridge 512. Print substance can be supplied to print cartridge 512 via fluid conduit 552 from feeder tanks (not shown in FIG. 5). A seal can be created by a first seal member (not shown in FIG. 5) included between valve neck 502 and inlet 514.

In an example in which printer valve 500 has to be detached from print cartridge 512, a seal can be created by a second seal member (not shown in FIG. 5) within valve body 510 prior to the seal between valve neck 502 and inlet 514 created by the first seal member being lost. Printer valves, according to the disclosure, can allow for attachment or detachment of printer valves to or from a print cartridge without loss of negative pressure in the printer valve. Maintaining the negative pressure in the printer valve can maintain a prime of the print substance included in fluid conduits supplying print substance from feeder tanks to a print cartridge. Maintaining the prime of the print substance can prolong an operational life of a print cartridge by allowing for inspection/maintenance of print cartridges without the loss of print substance prime.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2.

Elements illustrated in the various figures herein can be added, exchanged, and/or eliminated so as to provide a plurality of additional examples of the disclosure. In addition, the proportion and the relative scale of the elements provided in the figures are intended to illustrate the examples of the disclosure, and should not be taken in a limiting sense. As used herein, "a plurality of" an element and/or feature can refer to more than one of such elements and/or features.

What is claimed:

1. A system, comprising:

a print cartridge comprising an inlet having an internal dimension;

a printer valve to receive print substance from a fluid conduit and transmit the received print substance to the inlet, the printer valve comprising:

a valve neck having a first seal member having an external dimension that exceeds the internal dimensions of the inlet to provide a seal between the valve neck and the inlet responsive to insertion of the valve neck into the inlet;

a valve body having a biasing member; and an actuator located in the valve neck and the valve body and having a second seal member, wherein:

the biasing member is in an extended state while the valve neck is detached from the inlet of the print cartridge to form a seal within the valve body of the printer valve via the second seal member and maintain a negative pressure within the valve body;

the actuator is to contact the inlet to cause an application of force to the actuator after the first seal member is to provide the seal between the valve neck and the inlet; and the biasing member is to move from the extended state to a compressed state to enable flow of the print substance from the printer valve to the print cartridge.

2. The system of claim 1, wherein the biasing member connected to the actuator.

3. The system of claim 1, wherein the fluid conduit is between the valve neck and the valve body.

4. The system of claim 1, wherein a length of the actuator is greater than a combined length of the valve body and the valve neck such that a portion of the actuator protrudes from a bottom portion of the valve neck.

5. The system of claim 1, wherein the second seal member comprises an elastomeric material.

6. The system of claim 1, wherein the first seal member comprises an elastomeric material.

7. The system of claim 1, wherein the second seal member is to open the fluid conduit between the valve body and the valve neck to enable flow of print substance to the print cartridge via the valve body and the valve neck while the biasing member is in the compressed state.

8. The system of claim 1, wherein in response to application of force to the actuator the biasing member is to move from the extended state to a compressed state to enable flow of the print substance from the printer valve to the print cartridge.

* * * * *